US008500919B1

(12) United States Patent
Al-Qaffas

(10) Patent No.: US 8,500,919 B1
(45) Date of Patent: Aug. 6, 2013

(54) PORTABLE WASHER FOR BEVERAGE CONTAINERS

(71) Applicant: Qasem A. Al-Qaffas, Al Salaam (KW)

(72) Inventor: Qasem A. Al-Qaffas, Al Salaam (KW)

( * ) Notice: Subject to any disclaimer, the term of this patent is extended or adjusted under 35 U.S.C. 154(b) by 0 days.

(21) Appl. No.: 13/686,813

(22) Filed: Nov. 27, 2012

(51) Int. Cl.
*B08B 9/00* (2006.01)

(52) U.S. Cl.
USPC ..... 134/166 R

(58) Field of Classification Search
USPC ..... 134/166 R
See application file for complete search history.

(56) References Cited

U.S. PATENT DOCUMENTS

| | | | | |
|---|---|---|---|---|
| 1,706,189 | A | 3/1929 | Schmidt | |
| 2,104,272 | A * | 1/1938 | Partridge | 15/76 |
| 2,263,807 | A * | 11/1941 | Hanson | 15/75 |
| 3,209,273 | A | 9/1965 | Gallo | |
| 3,286,291 | A | 11/1966 | Linne | |
| 3,913,163 | A | 10/1975 | Durham | |
| 4,184,222 | A | 1/1980 | Wooten | |
| 4,791,693 | A | 12/1988 | Kvaternik | |
| 5,156,634 | A | 10/1992 | Yang | |
| 5,315,729 | A | 5/1994 | Yang | |
| 6,491,170 | B1 * | 12/2002 | Madela | 211/41.3 |
| 7,003,843 | B1 | 2/2006 | Moore | |
| 2006/0111260 | A1 * | 5/2006 | Peterson et al. | 510/180 |
| 2008/0185352 | A1 * | 8/2008 | O'Hara | 211/13.1 |
| 2010/0095983 | A1 * | 4/2010 | Barnhill et al. | 134/6 |

FOREIGN PATENT DOCUMENTS

| | | |
|---|---|---|
| GB | 306694 | 2/1929 |

* cited by examiner

*Primary Examiner* — Michael Barr
*Assistant Examiner* — Jason Ko
(74) *Attorney, Agent, or Firm* — Richard C. Litman

(57) ABSTRACT

The portable washer for beverage containers is a hand-carried device for providing clean coffee cups or other beverage containers to a social group where facilities with a large supply of clean containers may not be available. The portable washer includes a self-contained water supply and catch basin for used water, and internal electrical power to drive a plurality of rotary brushes for the mechanical scrubbing of containers. An electrically powered water heating element and water pump are also provided. The brushes are actuated by a push-rod switch extending up from the central rotary brush, the water pump and heater being powered by a separate master switch. Water is pumped through the tubular rotary brush supports to spray hot water from the brushes during washing operations. A removable splash guard and cover are provided. The cover has a carrying handle and external racks for the carriage of beverage containers.

12 Claims, 6 Drawing Sheets

PORTABLE WASHER FOR BEVERAGE CONTAINERS

BACKGROUND OF THE INVENTION

1. Field of the Invention

The present invention relates generally to dishwashing machines, and particularly to a portable washer for beverage containers providing for the storage of used containers, the washing of those containers with hot water, and the storage of the washed containers. The washer is particularly adapted for use with small coffee cups and the like.

2. Description of the Related Art

The custom of social or casual drinking of various beverages is nearly universal throughout the world. In many countries and cultures, social gatherings will generally include the consumption of coffee or tea, or perhaps other beverages. Indeed, the custom is so pervasive in many countries that specific words have developed to describe such gatherings, e.g., coffee klatsch, coffee break, tea time, high tea, etc.

Of course, a reasonable amount of coffee, tea, or other beverage is normally provided at such gatherings, along with a number of cups or other beverage containers. However, in certain circumstances it may be difficult to provide a sufficient number of containers or cups for all those present. The cups or containers must be shared, if all are to have some of the beverage. In fact, in many cultures and situations, it is customary for two or more individuals to drink from the same cup or container, as a gesture of friendship or camaraderie.

It will be seen that this is not conducive to the best hygiene practices, in that one or more individuals may be carrying some viral or bacterial infection that may be spread by contamination of one or more of the cups or containers. While no considerate person who has such an illness would knowingly share common containers, utensils or the like with others before washing them thoroughly, such contamination can still occur accidentally or inadvertently. And while minor illnesses such as the common cold or the like are of some concern, an even greater threat is the possibility of the transmittal of more serious diseases or illnesses from one person to another.

Accordingly, a number of machines and devices for the cleaning and washing of containers, utensils, and the like have been developed in the past. Most such machines are configured for permanent installation in a household or restaurant kitchen to relieve the manual labor associated with such washing tasks, and to speed the washing process.

Thus, a portable washer for beverage containers solving the aforementioned problems is desired.

SUMMARY OF THE INVENTION

The portable washer for beverage containers is a small, hand-carried device having a self-contained water supply and electrical power for a water heater element. The electrical power also serves to operate an electric motor for rotating inner and outer brushes to mechanically scrub a beverage container placed in the device. The brush actuation is operated automatically by a pushrod actuated switch extending from the central brush. Other electrical components (water heater and pump) are actuated by a separate master switch. A catch basin for used water is also provided. Thus, the portable washer is free of any need for connection to external plumbing, drainage, or water supply.

The carrying case comprises a cover removably installed over the water tank and base of the device. The removable cover also includes an external rack for the carriage of used and cleaned beverage containers. A removable splash guard or shield is also provided for installation around the brushes when the device is in operation. This configuration of the portable washer allows it to be carried easily by hand to any practicable location where the social drinking of coffee, tea, or other beverage may take place in order to provide clean cups or other beverage containers to all participants.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable washer for beverage containers enables a person to provide clean cups or other containers for the consumption of coffee, tea, or other beverage when no facilities for washing such cups or for providing additional cups are available. The device includes a self-contained supply of water and a catch basin for wastewater, as well as a heating element for the water and brushes for scrubbing the beverage container. Self-contained electrical power is also provided, or the device may alternatively be powered from an external electrical power source.

Figure 1:
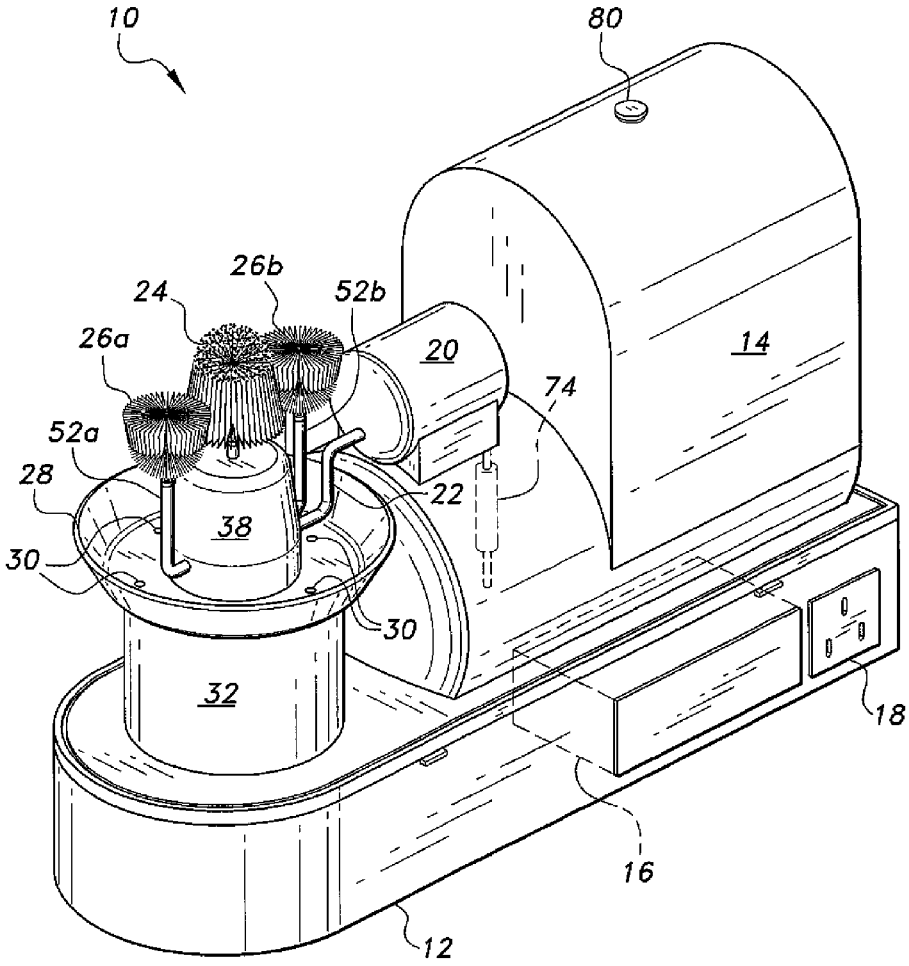
FIG. 1 is a perspective view of a portable washer for beverage containers according to the present invention as seen from the left side, shown with the covers removed to show various features thereof.
Figure 2:
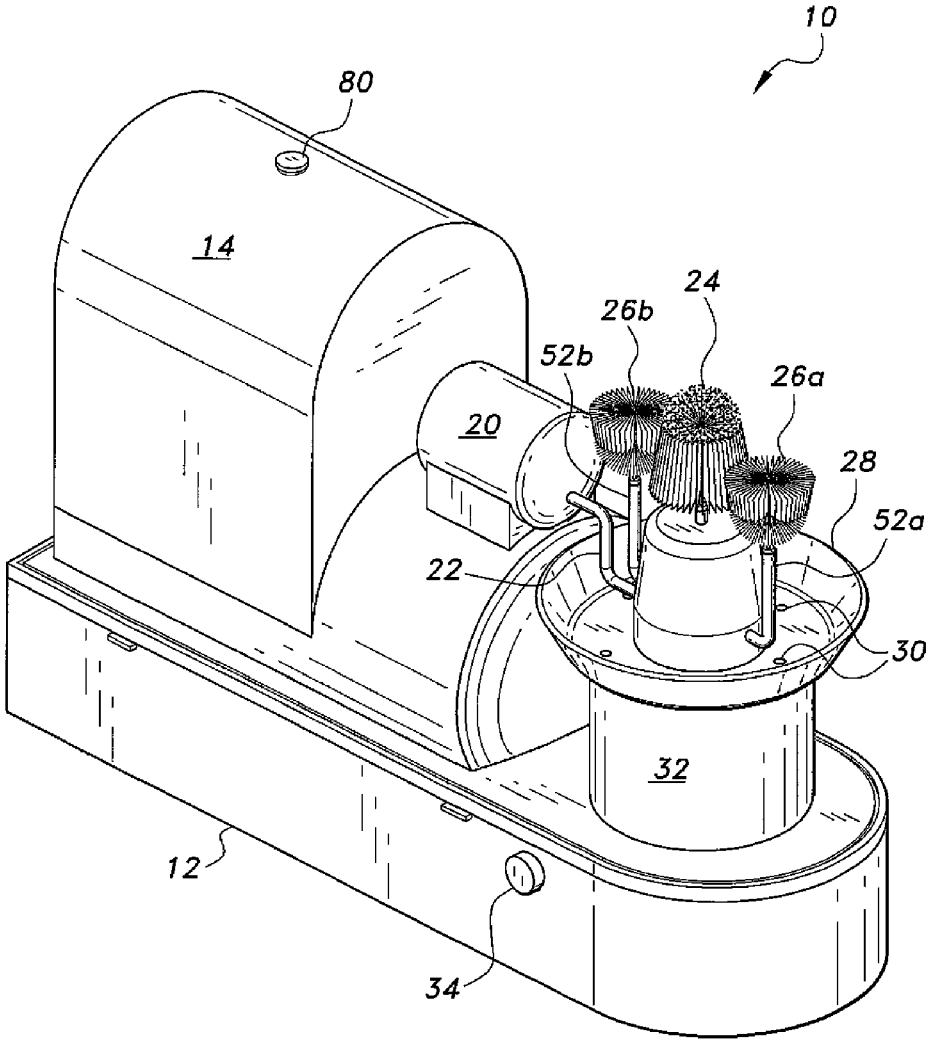
FIG. 2 is a perspective view of the portable washer of FIG. 1 as seen from the right side, showing additional features thereof.

FIGS. 1 and 2 of the drawings illustrate left and right side perspective views of the portable washer 10. The portable washer 10 includes a base 12 and a water supply tank 14 disposed atop the base. The base 12 may also contain an electrical battery pack 16 (shown in hidden lines in FIGS. 1 and 3, and schematically in FIG. 5) and a receptacle 18 for receiving electrical power from an external source of electrical power through an appropriate power cord. The battery pack 16 may be recharged by means of external electrical power received through the receptacle 18 and conventional charging circuitry (not shown).

An electrically powered water pump 20 is provided, e.g., installed atop a portion of the water tank 14. The pump 20 draws water from the tank 14 and delivers the water through a supply tube 22 to a central rotary brush 24 for scrubbing the interior of the beverage container, and to two diametrically opposed external rotary brushes 26*a* and 26*b* disposed laterally from the central brush 24 for scrubbing the exterior of the container. Each of the brushes 24, 26*a*, and 26*b* has a generally frustoconical configuration and a rounded tip. The central brush 24 has its rounded tip oriented upward, and the two external brushes 26*a* and 26*b* are inverted relative to the central brush 24. Details of the support structures and mechanisms for rotating the brushes 24, 26*a*, and 26*b* are illustrated in FIG. 5 of the drawings and explained further below.

Water is sprayed from the tubes supporting the three brushes 24, 26*a*, and 26*b*. The used wastewater falls into a basin 28 below the brushes. The basin 28 drains through passages 30 into a wastewater capture or catch tank 32 immediately therebelow. A drain outlet 34 provides for drainage of the wastewater from the catch tank 32 after washing operations.

Figure 5:
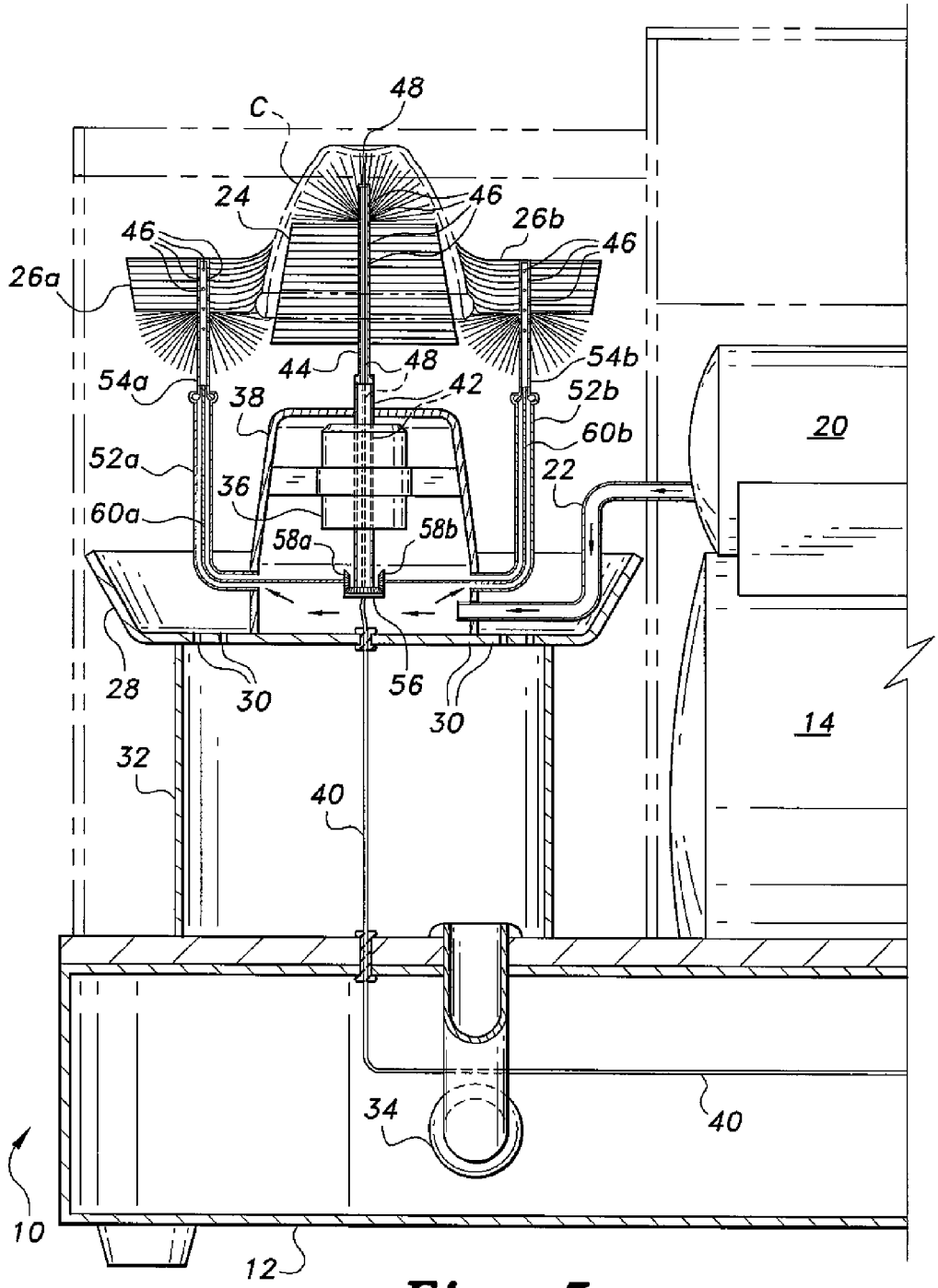
FIG. 5 is a partial left side elevation view in section of the forward portion of the portable washer of FIG. 1, showing details of the device.
Figure 6:
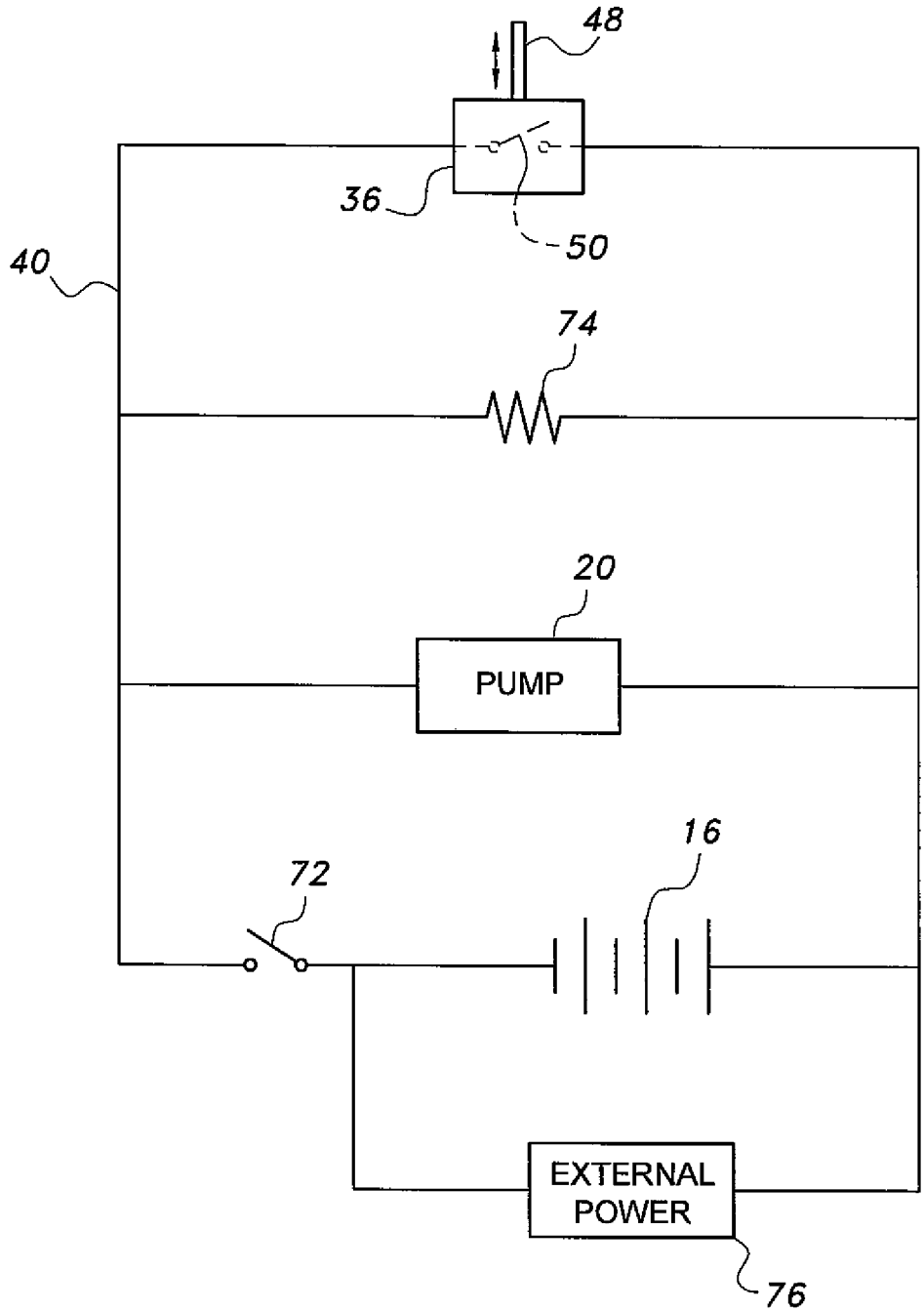
FIG. 6 is a schematic drawing of the portable washer of FIG. 1, showing various electrical components of the device schematically.

FIG. 5 of the drawings is a left side elevation view in section illustrating the various internal components and mechanisms for the operation of the portable washer 10. The three brushes 24, 26*a*, and 26*b* are driven by a sealed electric motor 36 secured within a waterproof housing 38. The motor 36 receives its electrical power from a wire 40 from the battery 16, or from appropriate conventional transformer and rectifier circuitry from the external power receptacle 18. The motor's power wiring 40 is sealed in its passage through the bottom and top of the wastewater capture tank 32 by elastomer grommets or other suitable sealing means. The motor 36 may be grounded by a conventional ground wire (not shown in FIG. 5, but shown schematically in FIG. 6) or grounded through conductive paths back to the battery 16 or receptacle 18.

The motor 36 has a hollow rotary driveshaft 42 extending therethrough. A tubular central rotary brush shaft 44 extends upward therefrom. The central brush 24 is affixed to the upper portion of the central brush shaft 44, and rotates therewith as driven by the motor 36. The central brush shaft 44 includes a plurality of water perforations or passages 46 therethrough, allowing the shaft 44 to serve as a water spray tube when water is pumped therethrough. The water emerges from the passages 46 and generally radially out through the central brush 24 to wash a cup or container C placed over the central brush 24. An exemplary cup or container C is shown in broken lines in FIGS. 3 and 5.

A central actuator rod 48 extends from beyond the upper end of the hollow brush shaft 44, down through the shaft 44 and into the hollow motor driveshaft 42. The actuator rod 48 communicates with an electrical switch 50 (shown schematically in FIG. 6 of the drawings, inside the motor 36) to actuate the motor 36. Pushing a cup or container down upon the central brush 24 pushes the actuator rod 48 downward, thereby causing it to close the switch 50 to actuate the motor 36 to rotate the central brush 24 within the cup or container C. Lifting the cup or container C from the central brush 24 allows the rod 48 to rise, thereby opening the switch 50 to shut off the motor 36.

Each of the two external brushes 26*a*, 26*b* is supported by a hollow non-rotating support tube, respectively 52*a* and 52*b*, extending from the housing 38. Each of these tubes communicates internally with the housing 38 to receive water therefrom as pumped into the housing 38 by the pump 20. The upper ends of each tube 52*a*, 52*b* is bulbed with an inwardly extending lip. This captures a mating flange disposed upon the lower end of each of the first and second external brush shafts 54*a* and 54*b*, allowing the shafts 54*a* and 54*b* to rotate relative to their stationary support tubes 52*a*, 52*b*. Each of the external brush shafts 54*a*, 54*b* is hollow and has a plurality of water spray passages or perforations 46 through the wall thereof. The upper ends of these two shafts or tubes 54*a*, 54*b* may be closed to force the water to flow through the passages 46. Water under pressure flows up through the two hollow support shafts or tubes 52*a*, 52*b* and into the two hollow brush shafts 54*a*, 54*b* to flow radially outwardly therefrom and through the respective external brushes 26*a*, 26*b* to wash the exterior surface of the cup or container C.

The two external brushes 26*a*, 26*b* are rotated mechanically. The lower end of the hollow central shaft 42 of the motor 36 has a bevel drive gear 56 affixed thereto and rotating therewith when the motor 36 is operating. First and second driven bevel gears 58*a* and 58*b* are driven by the bevel drive gear 56. Each of the driven bevel gears 58*a*, 58*b* has a flexible cable 60*a*, 60*b* extending therefrom and passing through the hollow external brush support tubes 52*a*, 52*b* to connect to their respective rotary external brush shafts 54*a*, 54*b* to rotate those shafts and their respective brushes 26*a* and 26*b* as the two driven bevel gears 58*a*, 58*b* are rotated. Guides may be provided to prevent lateral movement of the two cables 60*a* and 60*b*. In the arrangement depicted in FIG. 5, the two external brushes 26*a*, 26*b* will rotate in the same direction as the central brush 24 at some higher rotational speed due to the smaller diameter of the driven bevel gears 58*a* and 58*b* relative to the bevel drive gear 56. However, this arrangement is exemplary, and the two external brushes 26*a*, 26*b* may be made to rotate opposite the central brush 24 by reversing the bevel drive gear 56 to drive the upper edges of the two driven gears 58*a*, 58*b*. The relative rotational speeds may be adjusted by adjusting the diameters and pitches of the three gears 56, 58*a*, 58*b* relative to one another, as desired.

Figure 3:
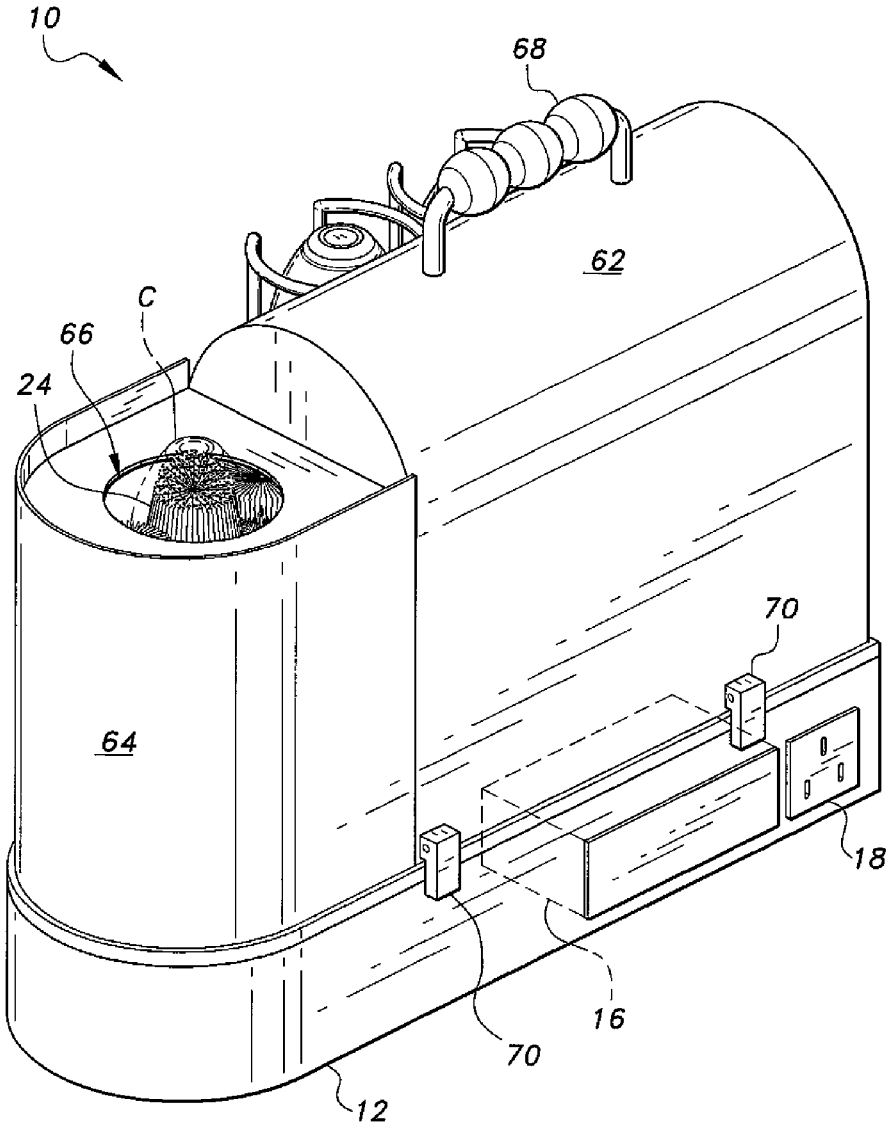
FIG. 3 is a perspective view of the portable washer of FIG. 1 as seen from the left side, shown with the covers installed.
Figure 4:
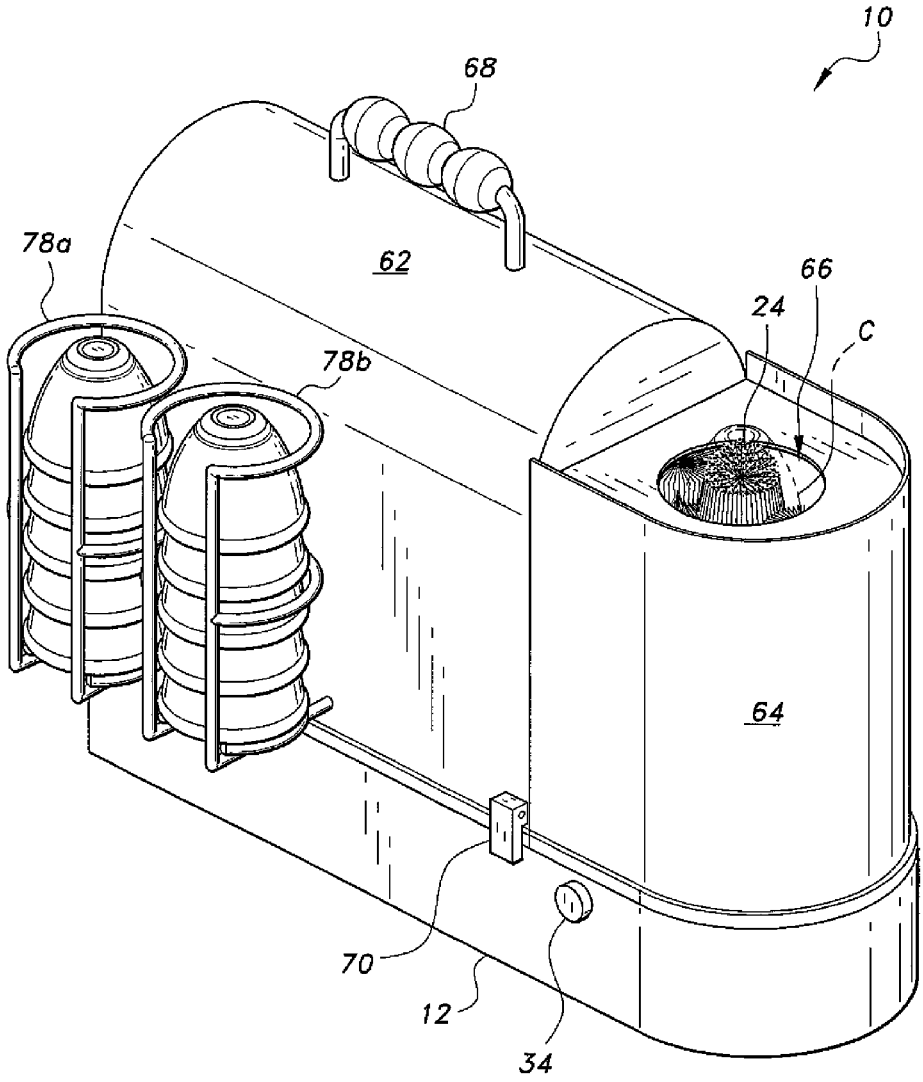
FIG. 4 is a perspective view of the portable washer of FIG. 1 as seen from the right side, shown with the covers installed.

FIGS. 3 and 4 provide views of the portable washer 10 in the same orientations as shown respectively in FIGS. 1 and 2, but showing a cover 62 installed over the water tank 14 and pump 20 areas of the device and a splash shield 64 installed over the water spray tubes and their brushes 24, 26*a*, and 26*b*. The splash shield 64 and/or the cover 62 may be transparent. A cup insertion opening 66 is provided through the top of the splash shield 64 to allow the insertion of a cup or container C therethrough to engage the brushes 24, 26*a*, and 26*b* beneath the splash shield 64. The cover 62 includes a carry handle 68 extending therefrom. The entire portable washer apparatus 10 is supported and carried by the carry handle 68 when the cover 62 is installed atop the device 10. A plurality of latches 70, e.g., conventional over-center latches or other mechanisms, is provided to secure the cover 62 to the base 12 to allow the cover to lift the entire assembly when the cover 62 is lifted by its carry handle 68.

The cover 62 and splash shield 64 are normally installed during operation of the portable washer 10, generally as shown in FIGS. 3 and 4. Operation is initiated by turning on a master switch 72 (shown schematically in FIG. 6) to provide electrical power to the water pump 20, water heater 74 (FIGS. 1 and 6), and the motor activation switch 50. The power may be provided either by a self-contained electrical battery 16 or by an external power source 76.

Water is drawn from the water storage tank 14 and through the water supply tube 78 extending from the bottom of the water tank 14 to the pump 20, actuated by closing the master switch 72, as described above. The water passes through an in-line water heater element 74, shown in broken lines in FIG. 1 and schematically in FIG. 6. The pump 20 then sends the heated water through the water delivery tube 22 and into the housing 38. Water under pressure then flows into the hollow motor driveshaft 42 and the two external brush support tubes 52*a* and 52*b*, and thence into the tubular central rotary shaft 44 and the two tubular external rotary brush shafts 54*a* and 52*b* to flow from their perforations or passages 46 and out through the brushes 24, 26*a*, and 26*b*.

The cover 62 is preferably provided with at least one external cup rack, and more preferably two external cup racks 78*a*, 78*b*, as shown in FIG. 4. Unwashed cups may be stored in one of the racks, e.g., the first rack 78*a*, and removed from that rack for washing by inverting the cup C and pushing it down over the central brush 24, generally as shown in FIGS. 3 and 4. This depresses the motor switch actuation rod 48 (FIG. 5) to close the motor switch 50 (FIG. 6), thereby actuating the three brushes 24, 26*a*, and 26*b*, as described further above, to clean the interior and exterior of the cup C. The cleaned cup C is then placed in the other cup rack, e.g., the second rack 78*b*, for further use. Wastewater from the cleaning operation falls into the catch basin 28 (FIGS. 1, 2, and 5) to drain through the drain passages 30 therein and into the wastewater catch tank 32. Wastewater may be drained from the catch tank 32 by means of the wastewater drain 34 when use of the portable washer 10 has been completed. The water supply tank 14 is provided with a filler opening and cap 80 (visible in FIGS. 1 and 2, with the cover 62 removed) to replenish the water supply.

It is to be understood that the present invention is not limited to the embodiments described above, but encompasses any and all embodiments within the scope of the following claims.

I claim:

1. A portable washer for beverage containers, capable to be carried by hand, comprising:

a base;

a water tank disposed upon the base;

a water heater;

a plurality of water spray tubes disposed above the base;

a brush radiating from each of the water spray tubes;

a wastewater tank disposed upon the base below the water spray tubes and the brushes;

a cover removably disposed over the water tank;

a carry handle disposed atop the cover; and at least one cup rack disposed upon the cover externally, and extending laterally therefrom, said at least one cup rack configured to support a plurality of cups stacked therein.

2. The portable washer according to claim 1, wherein the plurality of water spray tubes comprise:

a tubular central rotary brush shaft, the brush of the central rotary brush shaft having a generally frustoconical configuration; and first and second external rotary brush shafts disposed laterally from the central brush shaft, the external brush shafts being diametrically opposed to one another about the central brush shaft, each of the brushes of the first and second external rotary brush shafts having an inverted, generally frustoconical configuration, the portable washer further comprising a brush shaft drive motor disposed above the base, each of the rotary brush shafts communicating mechanically with the brush shaft drive motor.

3. The portable washer according to claim 1, further comprising:

a water supply tube extending from the water tank, the water spray tubes communicating with the water supply tube; and the water heater communicating with the water supply tube.

4. The portable washer according to claim 1, further comprising a water pump disposed between the water tank and the water spray tubes.

5. The portable washer according to claim 1, further comprising a splash shield removably disposed about the water spray tubes and the brushes.

6. The portable washer according to claim 1 wherein the at least one cup rack disposed externally upon the cover includes a plurality of cup racks.

7. A portable washer for beverage containers, to be carried by hand, comprising:

a base;

a water tank disposed upon the base;

a water supply tube extending from the water tank;

a water heater communicating with the water supply tube;

a plurality of water spray tubes disposed above the base, the water spray tubes communicating with the water supply tube;

a brush radiating from each of the water spray tubes;

a cover removably disposed over the water tank; and at least one cup rack, for containing a plurality of cups in a stack, extending outwardly from a side portion of the cover.

8. The portable washer according to claim 7 further comprising a wastewater tank disposed upon the base, below the water spray tubes and the brushes.

9. The portable washer according to claim 7, wherein the plurality of water spray tubes comprise:

a tubular central rotary brush shaft, the brush of the central rotary brush shaft having a generally frustoconical configuration; and first and second external rotary brush shafts disposed laterally from the central brush shaft, the external brush shafts being diametrically opposed to one another about the central brush shaft, each of the brushes of the first and second external rotary brush shafts having an inverted, generally frustoconical configuration, the portable washer further comprising a brush shaft drive motor disposed above the base, each of the rotary brush shafts communicating mechanically with the brush shaft drive motor.

10. The portable washer according to claim 7, further comprising a water pump disposed between the water tank and the water spray tubes.

11. The portable washer according to claim 7, further comprising a splash shield removably disposed about the water spray tubes and the brushes.

12. The portable washer according to claim 7, further comprising:

a carry handle disposed atop the cover.

* * * * *